US007143869B1

(12) United States Patent
Chance

(10) Patent No.: US 7,143,869 B1
(45) Date of Patent: Dec. 5, 2006

(54) HYDRAULIC VEHICLE LIFT

(75) Inventor: Mitch Chance, Clever, MO (US)

(73) Assignee: IGS, Inc., Springfield, MO (US)

( * ) Notice: Subject to any disclaimer, the term of this patent is extended or adjusted under 35 U.S.C. 154(b) by 323 days.

(21) Appl. No.: 09/507,379

(22) Filed: Feb. 18, 2000

(51) Int. Cl.
*B66F 7/04* (2006.01)

(52) U.S. Cl. ..... 187/208; 187/215; 187/253

(58) Field of Classification Search ..... 187/203, 187/206, 208, 209, 210, 213, 215, 217, 240–244, 187/251, 253, 272; 254/98, 284–286, 335–337, 254/4 R, 4 B, 4 C
See application file for complete search history.

(56) References Cited

U.S. PATENT DOCUMENTS

| | | | | | |
|---|---|---|---|---|---|
| 1,468,482 | A | * | 9/1923 | Lightner et al. | 187/213 X |
| 1,985,732 | A | * | 12/1934 | Jauch et al. | 187/209 |
| 2,139,597 | A | * | 12/1938 | Martin | 187/213 |
| 2,216,058 | A | * | 9/1940 | Thompson | 187/209 X |
| 2,538,517 | A | * | 1/1951 | Hayden | 187/213 X |
| 2,624,546 | A | * | 1/1953 | Haumerson | 187/213 X |
| 3,536,161 | A | * | 10/1970 | Clarke | 187/213 X |
| 3,557,908 | A | | 1/1971 | Villars | |
| 3,960,282 | A | | 6/1976 | Manaugh | |
| 3,985,207 | A | * | 10/1976 | Petit | 187/213 X |
| 4,076,216 | A | * | 2/1978 | Nussbaum | 254/98 |
| 4,079,847 | A | | 3/1978 | Kochanneck | |
| 4,588,048 | A | | 5/1986 | Rodriguez | |
| 4,724,875 | A | * | 2/1988 | Baldwin et al. | 187/211 X |
| 4,962,832 | A | | 10/1990 | Maney | |
| 5,018,925 | A | | 5/1991 | Ganser | |
| 5,197,714 | A | | 3/1993 | Metzen | |
| 5,207,297 | A | * | 5/1993 | Beattie et al. | 187/208 |
| 6,446,757 | B1 | * | 9/2002 | Taylor | 187/213 X |

FOREIGN PATENT DOCUMENTS

| | | | | |
|---|---|---|---|---|
| DE | 2739390 | A1 * | 3/1978 | 187/213 |
| FR | 1093591 | A * | 5/1955 | 187/213 |
| FR | 2576298 | A1 * | 7/1986 | |

* cited by examiner

*Primary Examiner*—Kathy Matecki
*Assistant Examiner*—Scott Haugland
(74) *Attorney, Agent, or Firm*—Lathrop & Gage L.C.

(57) ABSTRACT

A hydraulically operated vertical vehicle lift for working under the vehicle or for storing one vehicle over a second vehicle. The vehicle lift utilizes four large U-shaped columns which house most of the moving parts. Particularly, cables traverse through the columns and around pulleys attached to cross members supporting the vehicle ramps. A hydraulic cylinder under a ramp pulls the cables around the pulleys causing the cross members and ramps to elevate. The orientation of the cables and pulleys direct the force generated while elevating and suspending a vehicle straight down from the internal top center of each column. This directional force provides a stable vehicle lift and the columns and ramps shield the moving parts from operator contact and protect the parts from exposure thereby increasing their useful life of the lift.

16 Claims, 6 Drawing Sheets

HYDRAULIC VEHICLE LIFT

FIELD OF THE INVENTION

Th present invention relates to an improved hydraulic vertical car lift which can be used to elevate a vehicle for servicing, repair or storage.

BACKGROUND OF THE INVENTION

Numerous prior art devices have been disclosed which are used for lifting a vehicle for servicing, repairing or storing vehicles. However, there are many problems inherent with the known lifting devices, such as safety, functionality and durability. Due to the size, weight and bulk of an automobile, lifting devices must be sturdy, reliable and safe.

Devices commonly used to lift a vehicle for service or repair have a large, centrally positioned piston or ram, mounted in the floor or ground. When activated, the typical device will hydraulically lift the vehicle off the ground. These devices, while generally safe, limit accessibility to the underside of the lifted vehicle due to the size and central location of the piston.

Another type of known vehicle lift is referred to as a cantilever lift. These devices utilize a pair of opposed stanchions, generally located near one end of the vehicle lift. The vehicle is driven onto a platform or pair of ramps between the stanchions. A lifting mechanism, generally hydraulic or screw driven, is located at one end of the platform or ramp. Stanchions are preferred because they are generally positioned near one end of the device and allow unrestricted access to the door of the vehicle once it is driven onto the platform or ramps.

The use of such stanchions leads to problems. In particular, the force applied to the cantilever lifting mechanism is not uniform or directional. As safety is always a major concern when lifting a vehicle off of the ground, it is necessary to evaluate the application and direction of force imposed on the lifting device by the weight of the vehicle. The cantilever type of car lifts have known safety problems. It is not uncommon for the end of the platform opposite the stanchions to sag, allowing the vehicle to roll or slide off, or even to collapse. Further, constant stress imparted on the lifting device from the weight of the vehicle tends to weaken the structural integrity of the device and results in undesirable maintenance and repairs.

Efforts directed to modifying the typical two-stanchion cantilever car lift have resulted in increasing the number of stanchions, or changing the location of the stanchions. Increasing the number of stanchions, or moving the stanchions to a central position, has improved safety and reliability of the vehicle lifting device. This arrangement is still not preferred because the weight of an elevated vehicle makes it desirable to have a sturdy lifting device and it is preferable to have the vehicle supported at each corner.

Heavy items, when elevated, lose stability and become difficult to move. It is often necessary to move a vehicle while on a lift, for storage purposes or to accommodate mechanical repairs. If the vehicle is not operational, it is difficult to remove it from the lift, move the lift and then replace the vehicle. The simple solution is to provide a vehicle lift which can be easily moved with a vehicle in place. Even though some of the cantilever type car lifts are provided with wheels or casters, when a vehicle is on the lift and elevated, it is difficult to move and the likelihood of the vehicle coming off of the lifting device is high.

An alternative arrangement being used has four post lifts located at the approximate four corners of the device. By positioning a post at each corner of the lift device and supporting a vehicle on a platform or ramps supported between the post, a stable environment may be achieved for working under the suspended vehicle or for storing a second vehicle under the suspended vehicle. Generally, four post lift devices are powered by at least one mechanical screw assembly which alternately raises and lowers the platform or ramps depending on the direction of screw rotation. Some four post devices utilize one or two vertically positioned hydraulic rams at, or near, the posts and push or pull, depending on orientation, the vehicle into a lifted position.

Another variation of the four post lift is the hydraulically powered cable lift. These devices generally utilize one or more cables, attached to the outer periphery of each corner post, and strung through a series of pulleys and attached to a hydraulic ram. When the ram is activated, vertical elevation of the vehicle is achieved. Universally, regardless of the type of lifting device, there are exposed working parts. The various driving mechanisms found on lifts, such as: screw assemblies, hydraulics and gears and chains are generally attached to the outside of one or more of the stanchions or posts. These parts account for injuries to operators, damage to the vehicles, accumulation of dust and dirt, and tend to wear quickly due to exposure to the elements.

A significant disadvantage of known four post lifts is the manner in which the lifting mechanism applies the force necessary to elevate a vehicle. Typically, the lifting mechanism will include a series of cables and pulleys fastened on the outer surface of each column. A common attachment point for the lifting cables is on an overhanging outside edge of a top cap, typically fashioned of plate metal. The position of the cables on the outer edge of the top cap results in significant directional force applied unevenly away from the center of each column when a vehicle is elevated.

The positioning of the cables on the outside perimeter of each column decreases the stability and safety of the vehicle lift. In instances where the columns are not fastened to the ground, or suitable flooring, the inward directional force may lead to collapse of the device. Further, the connection point of the cables, as well as related parts of the device, are under constant angular strain, resulting in rapid wear, distortion or failure of components.

What is needed is a vehicle lift which is stable and durable. Further, it is desirable to provide a vehicle lift which is easy to use, which is safe and has very few exposed moving parts which could injure the operator.

SUMMARY OF THE INVENTION

A vehicle lift in accordance with the present invention is generally manufactured from high quality steel and industrial strength components. A U-shaped column is provided at each corner of the lift, with each column fixed to a large, flat base which stabilizes the entire lift. The lifting mechanism includes a first and second cross member, each having opposing ends. Each end of each cross member is slidably secured within a long vertical slot provided in each opposed column. A cable is attached within each column substantially at the center of a top plate of each column, and each cable is connected to a pulley provided at the end of the cross member in that column. The opposite end of each cable attaches to a hydraulic cylinder.

The vehicle lift has a pair of spaced-apart ramps, which are wide enough to accommodate almost any tire width and almost any vehicle width. Further the ramps are movable to accommodate a vehicle with unusually narrow or wide axles. The ramps overlie and are supported by the two cross members. When the hydraulic cylinder is operated, it causes the cables to shorten and the cross members to rise on the pulleys up the cable in each column. Thus the vehicle is lifted.

Importantly, because the cables are uniquely attached at the top center of each of the four columns, the weight of the vehicle on the ramps directs the force downward on each cable. There is no lateral pull on the cables and no side to side movement. This means that as the vehicle is being lifted, there is no shaking of the lift mechanism, as is common with the heretofore known vehicle lifts. The downward directional force on the cables also decreases wear on the lift parts and adds to the safety of the device.

Another advantage of the instant invention is that lifting parts, such as the cables, pulleys and lifting blocks on the cross members are all positioned within the columns. Further, cables, pulleys and hydraulics are positioned under the ramps. This placement of the working parts of the vehicle lift limits access during operation and decreases the likelihood of the operator becoming injured. Further, the placement of the parts limits exposure of the mechanical components to dirt and the environment, thereby increasing the life of the lift and improving operation. A flexible dust cover over the vertical slot in each column will further protect parts from dust and exposure and will also limit access to the moving parts during operation.

A lock latch located at the end of at least one of the cross members, can be manually inserted, via a lever, into one of several tabs fixed in the associated column. With a lock latch in place the ramps can not move downward. This locking arrangement increases safety and limits unintentional movement of the vehicle lift and further ensures that a vehicle on the lift will not be lowered in the event of failure of any of the moving parts.

For safety purposes, the vehicle lift has a tire block mounted at the front edge of both of the spaced-apart ramps. Additional tire blocks can be positioned on the back edge of each ramp after the vehicle is in place, to keep the vehicle from rolling backward off the ramps during, or after, elevation. Another feature of the device includes one or more movable drip trays which lay on an inner tray lip running the length of each of the ramps. The drip trays prevent fluids and debris from the elevated vehicle from damaging an underlying vehicle, or simply from making a mess on the floor. Also, a jack stand can be placed along the same inner tray lips. The jack stand allow a portion of the vehicle to be further elevated while on the vehicle lift, which facilitates working on the vehicle for example to change a tire or brakes. As it may be desirable at times to move the vehicle lift without removing the vehicle off of the ramps, casters can be pivotally mounted near the base of each of the spaced apart columns. The casters can be selectively engaged to allow movement of the lift, or stored off the ground to allow temporary fixed positioning of the lift.

An electrical contact shut off switch can be mounted within one or more of the four columns substantially adjacent the cable therein. When the platforms are elevated to the desired vertical position, the shut off switch will be slid to a point where it touches a portion of the cross member and is then fastened in place. When the cross member contacts the shut off switch during subsequent operation of the vehicle lift, the electric supply to hydraulic pump will be interrupted and vertical movement will stop. This is a particularly nice feature when using the vehicle lift to store a car in an area with limited height clearance. The vehicle can be lifted to its maximum height the first time, then when the shut off switch is positioned, the operator will not have to worry about lifting the car too high during subsequent elevations.

DETAILED DESCRIPTION OF THE INVENTION

The present invention relates to a hydraulically operated vertical vehicle lift which allows for a person to work under the vehicle or for storing one vehicle over a second vehicle. The vehicle lift utilizes four large U-shaped columns positioned at each corner of the lift for stability and safety. A vehicle is elevated by a series of cables traversing through the U-shaped columns and around pulleys attached to cross members supporting the vehicle ramps. A hydraulic cylinder provides the lifting force. The orientation of the cables and pulleys direct the force, generated while elevating and suspending a vehicle, in a downward direction, as opposed to an angular direction, from the internal top center of each column. This directional force provides a stable vehicle lift and the columns and ramps shield the moving parts from operator contact and protect the parts from exposure thereby potentially increasing their useful life.

Figure 1:
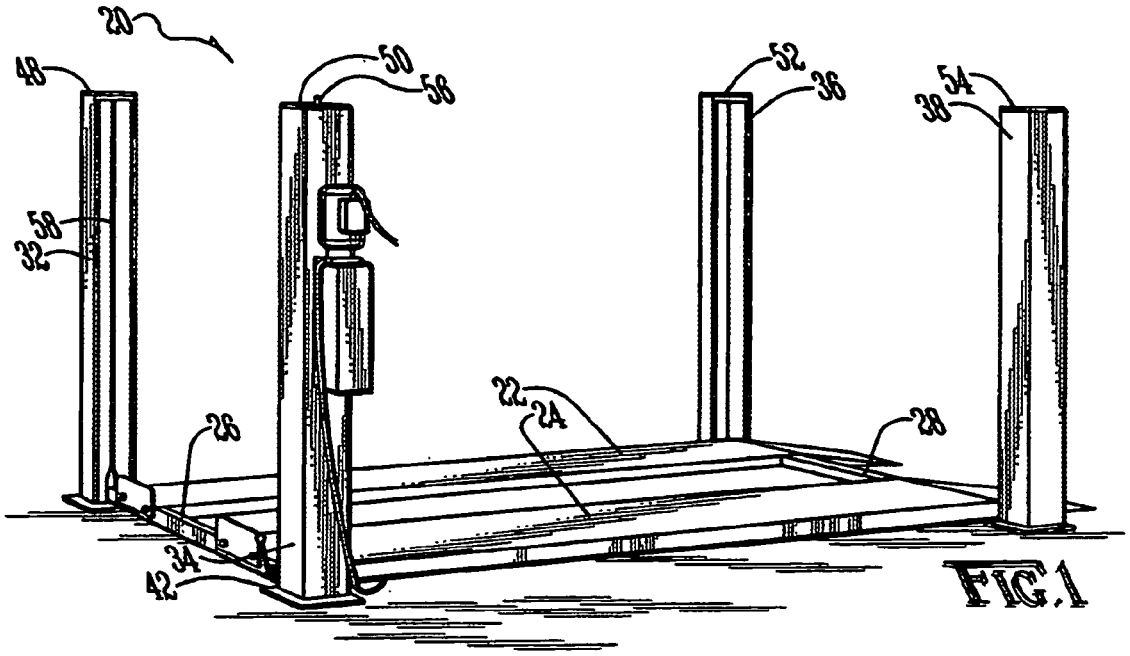
FIG. 1 is a side perspective view of the preferred embodiment of the vertical car lift in a lowered position.
Figure 4:
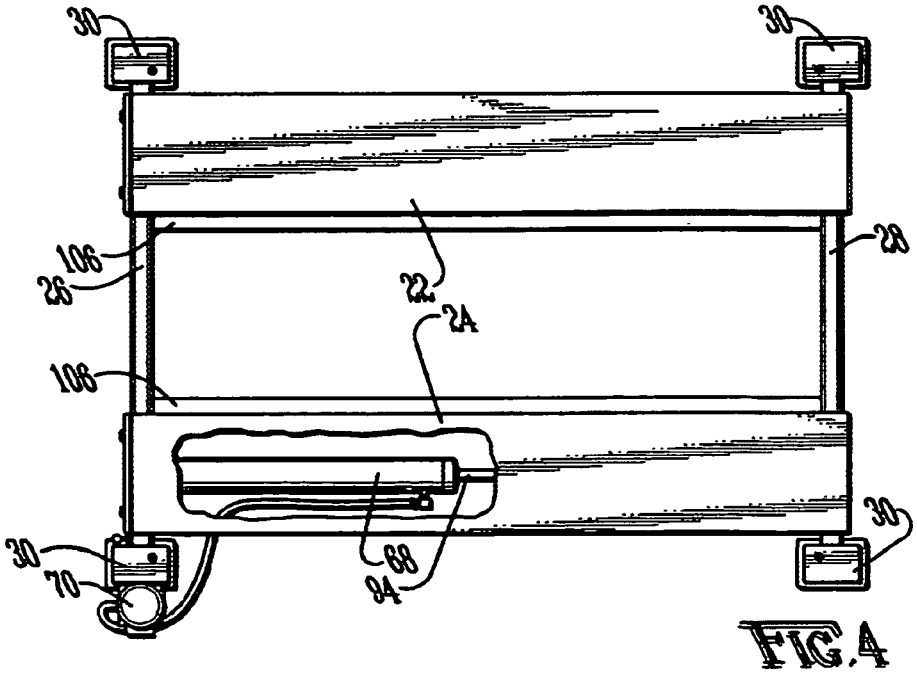
FIG. 4 is a top partial view of the lift platform of the present invention with a cutaway view showing the preferred location of the hydraulic mechanism.

Referring now to the drawings in general, a vehicle lift 20 in accordance with the present invention is generally manufactured from steel and industrial strength components. As shown in FIG. 1, the vehicle lift 20 is constructed with a pair of spaced-apart ramps 22 and 24 slidably connected to and supported by a pair of opposed cross members 26 and 28. It is preferred that the spaced-apart ramps 22 and 24 have a slot near each end which receives one of the cross members 26 or 28. The cross members 26 and 28 are substantially perpendicular to the spaced-apart ramps 22 and 24 and retain the orientation of to form an equilateral rectangle large enough to accommodate a standard passenger car, truck or van. As shown in FIG. 4 the first cross member 26 and the second cross member 28 each have opposed end blocks 30 fixed at each end of each of the cross members 26 and 28.

Figure 2:
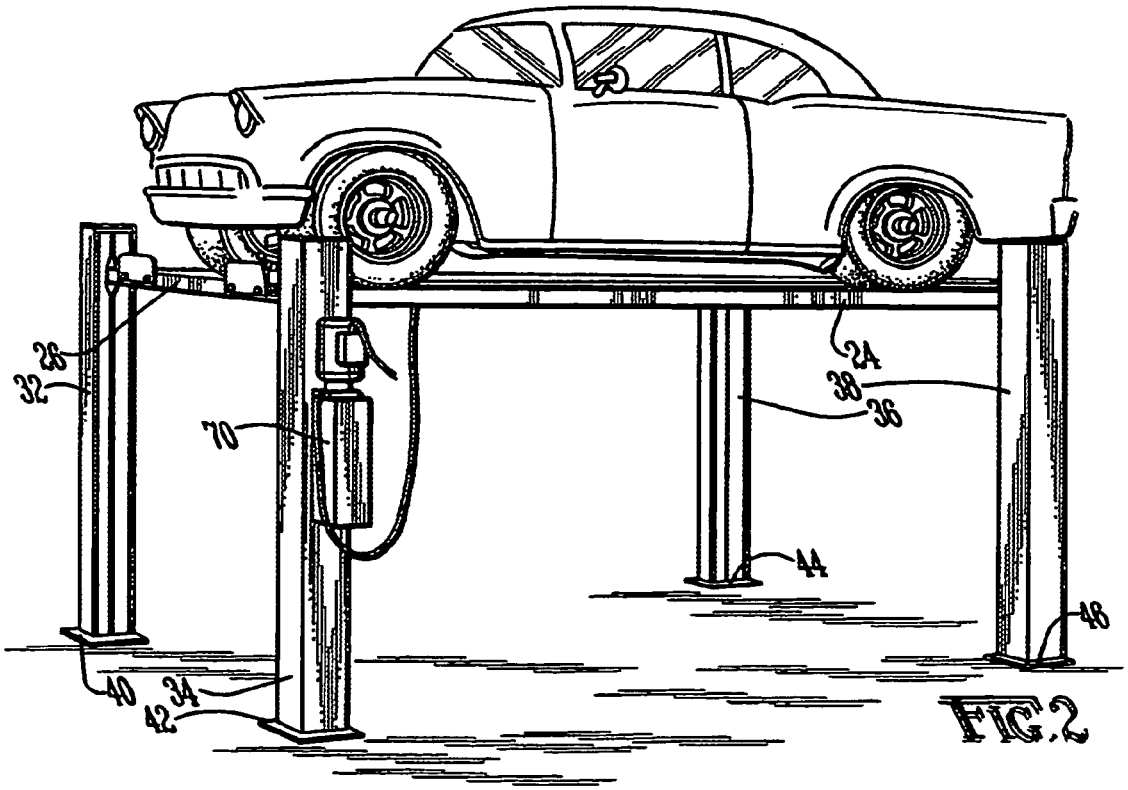
FIG. 2 is a side perspective view of the preferred embodiment of the vertical car lift in an elevated position.
Figure 3:
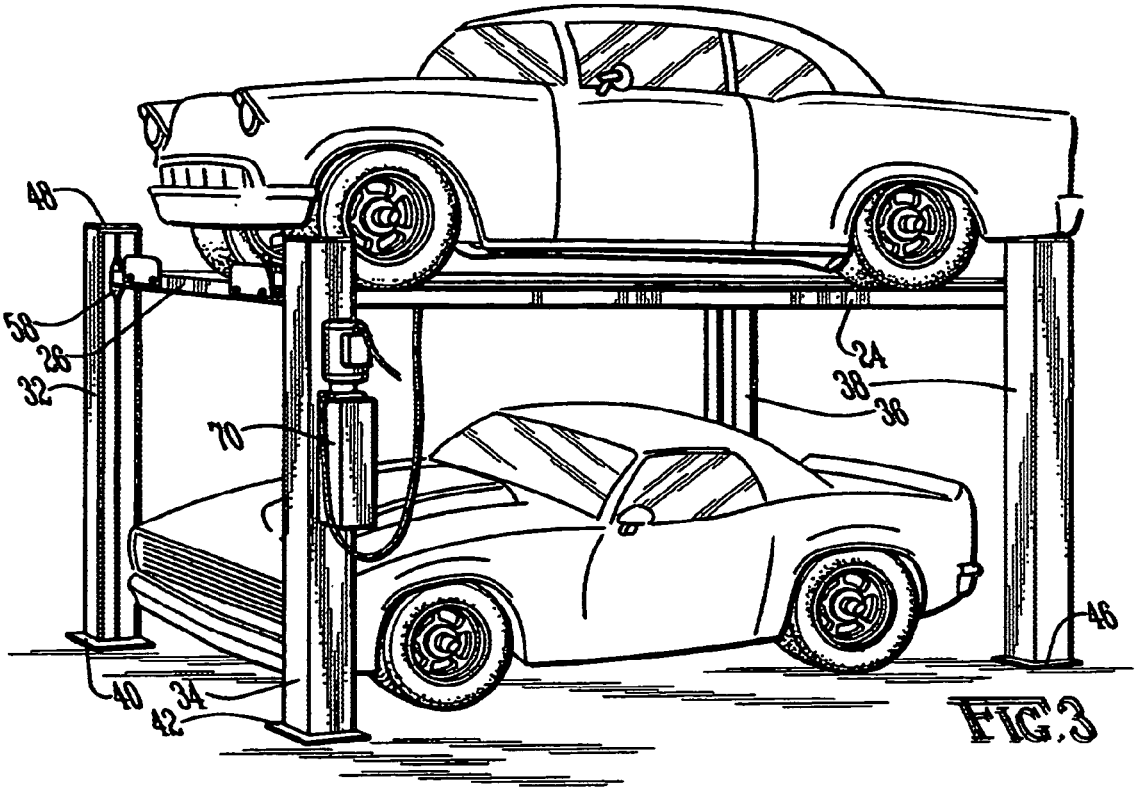
FIG. 3 is a side perspective view of the preferred embodiment of the vertical car lift in an elevated position, with a second automobile located under the lift.
Figure 9:
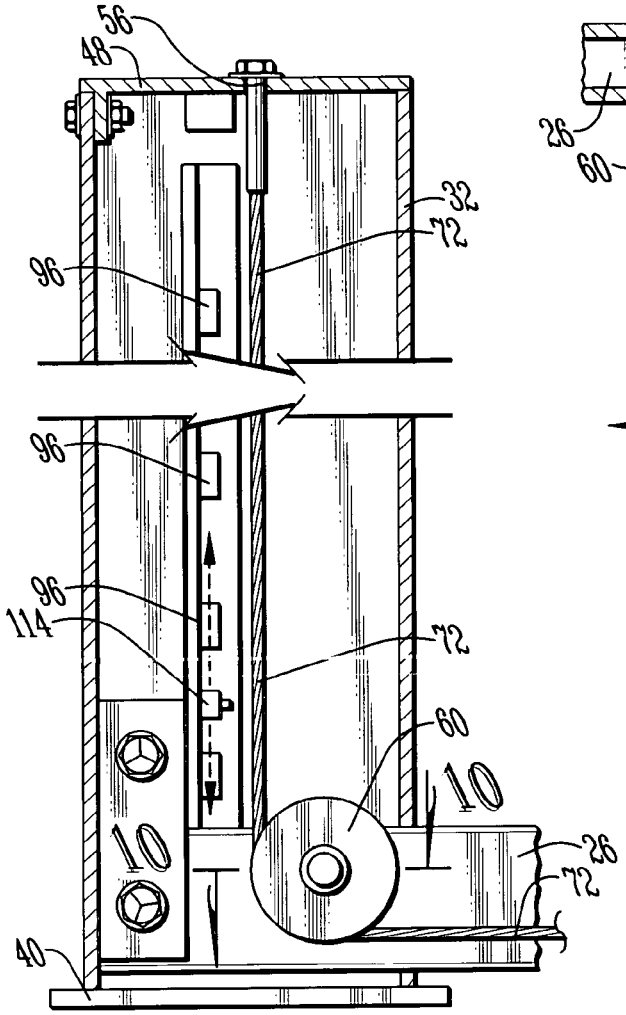
FIG. 9 is a fragmentary cutaway view of one of the corner posts.

The structure for the vehicle lift 20 includes four spaced apart columns 32, 34, 36, and 38, shown in FIGS. 1–3 with each column located at one of the four corners formed by the cross members 26 and 28 and the pair of spaced-apart ramps 22 and 24. Each of the four columns 32, 34, 36 and 38 is substantially U-shaped, with three sides and an open face. Each column has a base 40, 42, 44, and 46 attached thereto, with such bases providing a stable surface for the vehicle lift 20 and which may be used to secure the vehicle lift 20 to the ground flooring. At an end opposite each base is a top cap 48, 50, 52 and 54, which may be fixed or removably fastened to the column. Examples of suitable fasteners include clips or bolts. Each top cap 48, 50, 52 and 54 must be formed of strong material, preferably plate steel, and will also be provided with a cable receiving hole 56 therein, as shown in FIG. 9, positioned substantially near the center of each top cap 48, 50, 52 and 54.

Figure 5:
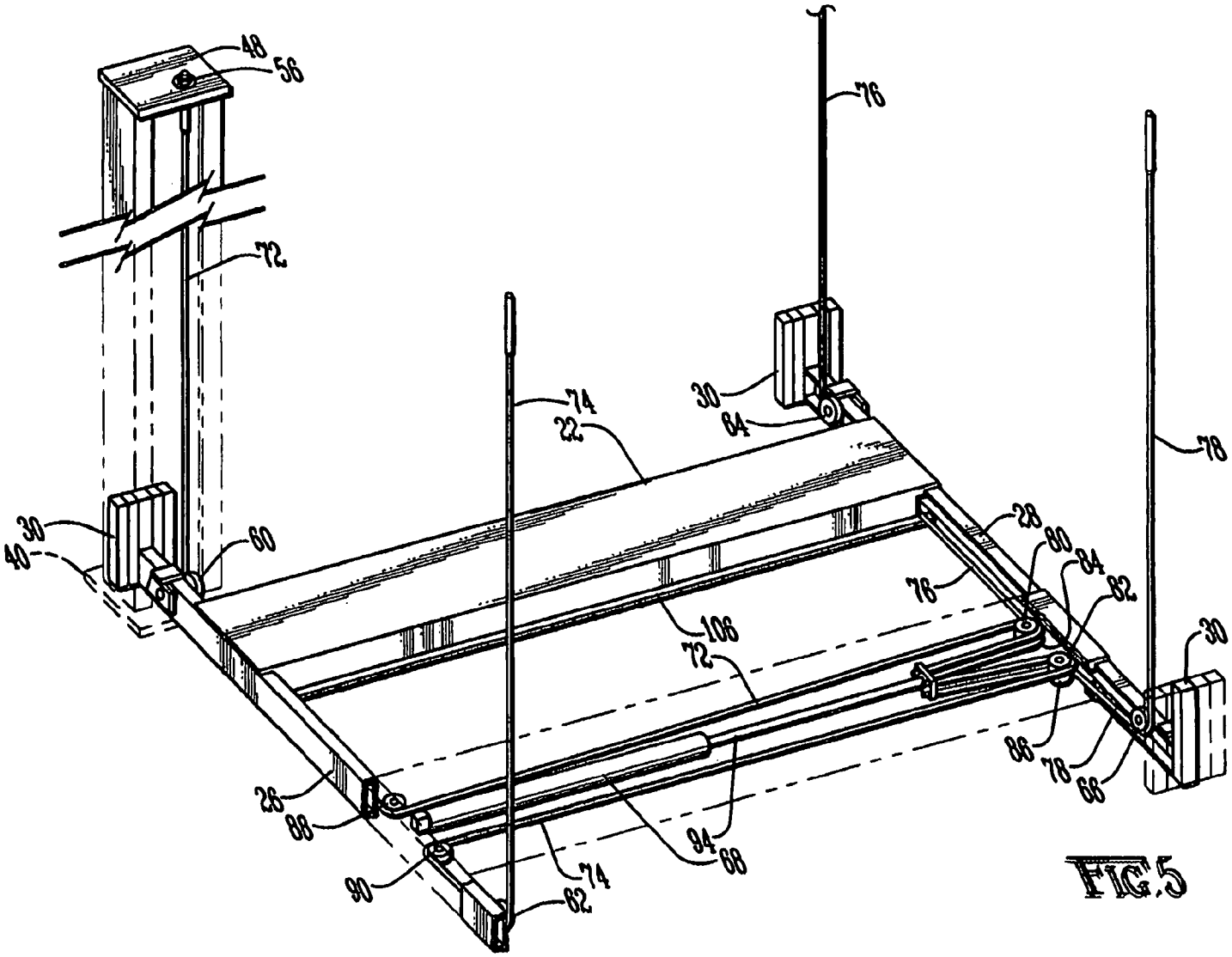
FIG. 5 is a side partial view of the present invention showing the preferred arrangement of the lifting cables.

As shown in FIGS. 1 through 3, the four U-shaped columns 32, 34, 36 and 38 each have a slot 58, for receiving one of the end blocks 30 of one end of each cross member 26 and 28, extending substantially from each base 40, 42, 44 and 46 to each top cap 48, 50, 52 and 54 of the respective columns 32, 34, 36 and 38. Each of the columns 32, 34, 36 and 38 are oriented with their respective cross member receiver slots 58 positioned inwardly toward the first cross member 26 and the second cross member 28 as shown in FIG. 1. Each end block 30 of both the first cross member 26 and the second cross member 28 are slidably received within one of the cross member receiver slots 58. Further, as shown in FIG. 5, a first pulley 60 is fixed proximate the end block 30 which is received in the first U-shaped column 32. A second pulley 62 is positioned at the end block 30 adjacent the second U-shaped column 34; a third pulley 64 is positioned at the end block 30 adjacent the third U-shaped column 36 and a fourth pulley 66 is positioned at the end block 30 of the fourth U-shaped column 38. Each of the four cross member end blocks 30 and each pulley 60, 62, 64 and 66 located at one of each of the four end blocks 30 are positioned within one of the U-shaped columns 32, 34, 36 and 38 respectively, via each respective cross member receiver slot 58.

The vehicle lift 20 may be operated by any powered device capable of raising and lowering the weight of a vehicle positioned on the lift 20. As shown in FIGS. 4 and 5, power to elevate the vehicle lift 20 is preferably a hydraulic cylinder 68 which may be attached to any rigid portion of the vehicle lift 20, preferably underneath one of the ramps 22 or 24. The hydraulic cylinder 68 is linked to a hydraulic pump 70.

It is possible to operate the device 20 using two separate hydraulic cylinders, one positioned at the first cross member and one at the second cross member. However, a single cylinder 68 is preferred. Four cables 72, 74, 76 and 78 as shown in FIG. 5, are attached to the hydraulic cylinder 68. It is preferred to route each cable around at least one of four directing pulleys 80, 82, 84, or 86. The first cable 72 is routed around directing pulley 80 and a first forward pulley 88 to the first pulley 60 adjacent the first U-shaped column 32. The second cable 74 is routed around directing pulley 82 and a second forward pulley 90 to the second pulley 62 adjacent the second U-shaped column 34. The third cable 76 is routed to the third directing pulley 84 and to the third pulley 64 adjacent the third U-shaped column 36. Finally, the fourth cable 78 is routed to the fourth directing pulley 86 and to the fourth pulley 66 adjacent the fourth U-shaped column 38.

Each cable 72, 74, 76 and 78 is attached at the respective top cap 48, 50, 52 or 54 of the respective U-shaped column 32, 34, 36 or 38 where it is received and maintained within the cable receiving hole 56 provided therein. Consequently, each of the U-shaped columns 32, 34, 36, and 38 houses one cable 72, 74, 76 or 78 which is routed along one or the pulleys 60, 62, 64 or 66. Each cable 72, 74, 76, and 78 have a securing end positioned through and fixed at the cable receiving hole 56 in one of the top caps 48, 50, 52, 54 of one of the U-shaped columns 32, 34, 36, and 38 such that there is one cable positioned entirely within each U-shaped column.

As shown in FIG. 5, each of the cables 72, 74, 76, and 78, is secured to a cable block 92 which is secured on a cylinder ram 94 of the hydraulic cylinder 68. The actuation of the hydraulic cylinder 68 pulls each the cables 72, 74, 76 and 78 through the respective set of pulleys resulting in vertical movement of the first cross member 26, the second cross member 28 and the spaced-apart ramps 22 and 24. The cables 72, 74, 76 and 78 can be any wire or cable having tensile strength great enough to support the weight of a domestic motor vehicle, or approximately 3500 pounds or more. It is preferable to use aircraft quality cable rated at 14,500 pounds per cable for durability and safety.

Figure 6:
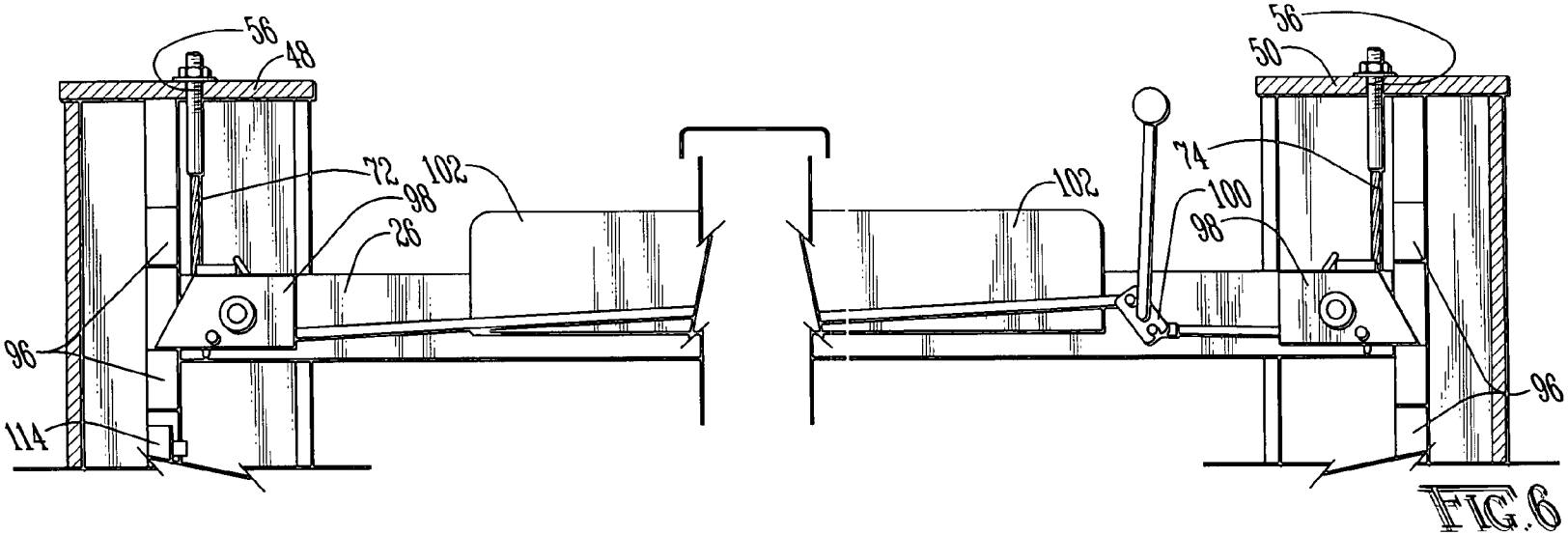
FIG. 6 is a partial fragmentary view of the locking mechanism of the present invention in the locked position.

Referring to FIG. 5 the cross member end blocks 30 may be constructed to have approximately the same width as the inner confines of each column which limits lateral movement of the cross member 26 or 28 within the U-shaped column 32, 34, 36, or 38. Fixed within at least one of the U-shaped column 32, 34, 36, or 38 is a plurality of spaced apart vertical locking tabs 96 positioned to be selectively engaged by a lock latch 98 on the cross member end block 30 received within the specific U-shaped column as shown in FIG. 6.

Figure 7:
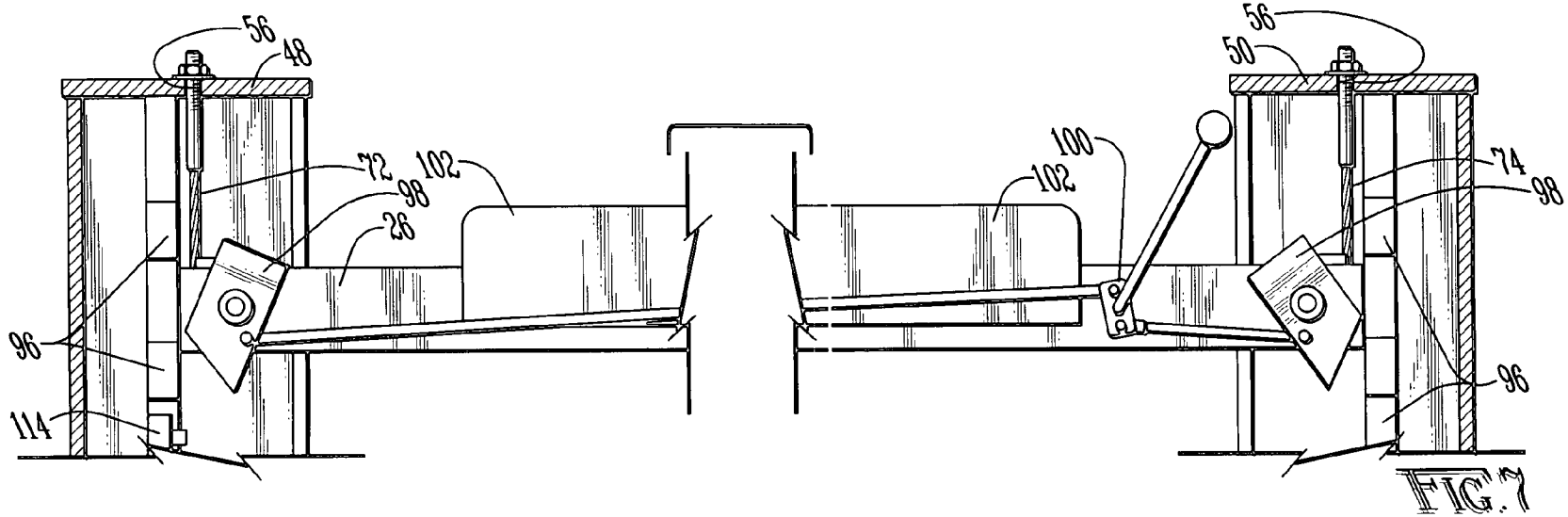
FIG. 7 is a partial fragmentary view of the locking mechanism of the present invention in the unlocked position.

It is desirable to have a locking mechanism for holding the lift in place, particularly in the elevated position, for safety purposes. Shown in both FIGS. 6 and 7, the lock latch 98 is preferably a machined billet Heim end which is mechanically manipulated by a cam lever-type lock linkage 100. Manipulation of the lock linkage 100 forces the lock latch 98 into one of the plurality of spaced apart locking tabs 96 thereby preventing vertical movement of the cross members 26 and 28 and the associated spaced apart ramps 22 and 24. This locking arrangement increases safety and limits unintentional movement of the vehicle lift 20. It further ensures that a vehicle on the lift will not be lowered in the event of failure of any of the moving parts.

Several accessories can easily be mounted on the vehicle lift 20. For safety purposes, the vehicle lift 20 should have a tire block mount 102 at each end of both of the spaced-apart ramps 22 and 24, as shown in FIGS. 1–3. The tire block 102 is easily fastened or removed and prevents a vehicle from rolling off the spaced-apart ramps 22 and 24.

Figure 8:
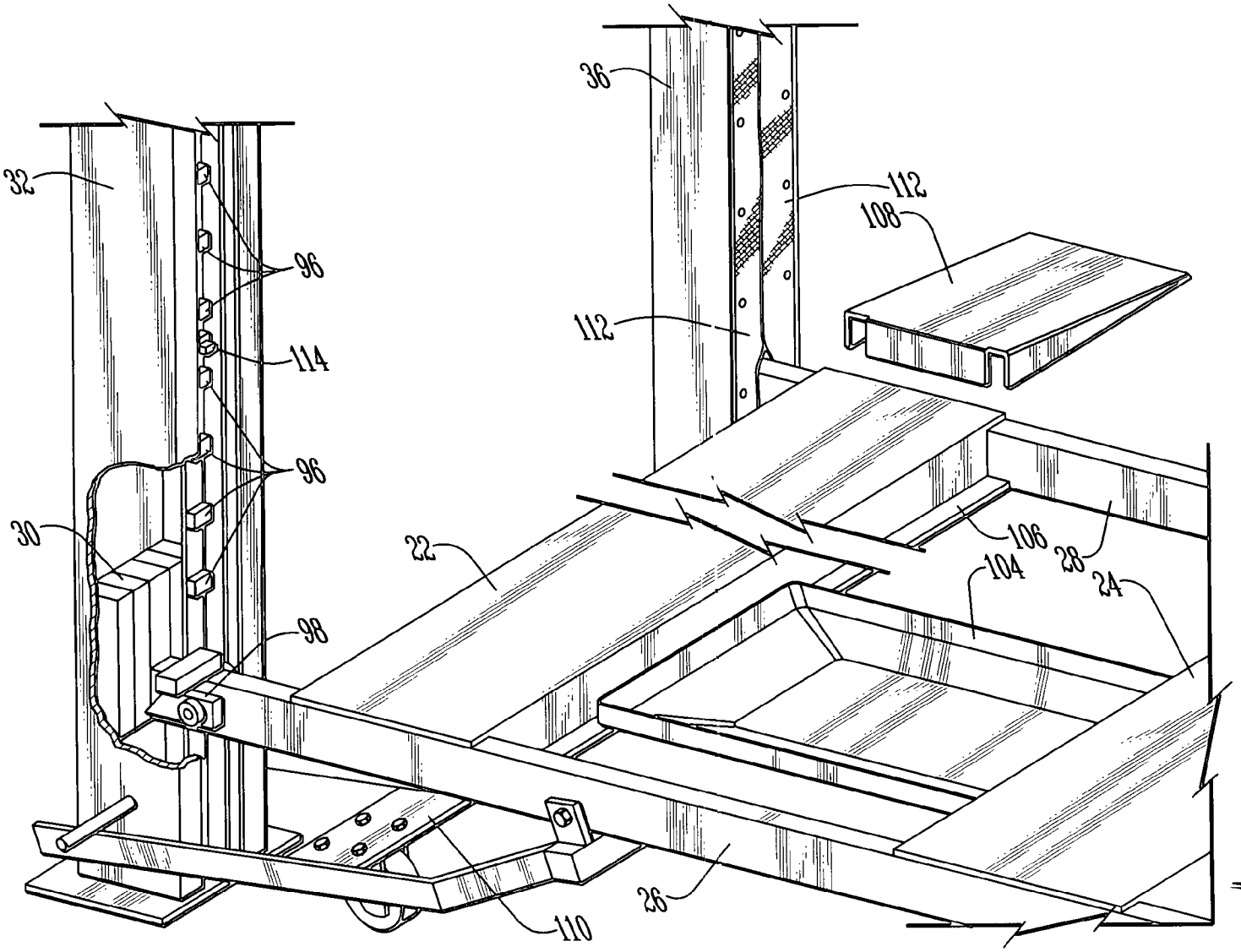
FIG. 8 is a partial fragmentary side view of the present invention.

Another accessory, shown in FIG. 8 is one or more drip trays 104 which lays on an inner tray lip 106 running the length of each of the spaced-apart ramps 22 and 24. mounted between the pair of spaced apart ramps. The drip trays 104 prevent fluids and debris from the elevated vehicle from damaging an underlying vehicle, or simply from making a mess on the floor. The inner tray lip 104 can also be used to support a sliding jack stand. The jack stand is a flat rigid beam can be moved the length of the ramps 22 and 24, and will allow a portion of the vehicle to be further elevated. This will particularly be desirable for working under the elevated vehicle, for example, to change tires or remove transmissions. Loading ramps 108 may be selectively attached to the second cross member 28 to facilitate loading vehicles with little ground clearance.

As it may be desirable at times to move the vehicle lift 20 without removing the vehicle off of the ramps 22 and 24, a plurality of casters 110 can be pivotally mounted near the base 40, 42, 44, 46 of each of the spaced apart columns 32, 34, 36, and 38 as shown in FIG. 8. Since the vehicle lift 20 should not be moved when the vehicle is elevated, due to safety concerns, the casters 110 will ideally be mounted near the base 40, 42, 44, 46, and substantially near the cross rail receiver slot 58, in a manner such that when the hydraulic cylinder 68 is extended, allowing the cross members 26 and 28 to move vertically downward, the downward force will push the casters onto the floor and raise the four U-shaped columns 32, 34, 36, and 38 off of the floor. The casters 110 can be locked into position so that the vehicle lift can be moved about without having to maintain downward force on the casters 110 via the hydraulic cylinder 108 or from the weight of a vehicle on the ramps 22 and 24.

One of the persistent problems with vehicle lifts in general has been the presence of dangerous, dirty moving parts. As described herein, all of the moving parts of the vehicle lift 20 housed within the U-shaped columns 32, 34, 36, and 38 or under the ramps 22 and 24. Referencing FIG. 8, a flexible slotted dust cover 112 can be mounted over the cross member receiver slot 58 of each of the four spaced-apart U-shaped columns 32, 34, 36 and 38. This dust cover 112 prevents unwanted contact with moving parts, particularly the cables 72, 74, 76, and 78 and the lock latch 98 during operation of the vehicle lift 20. Further, the operational parts housed in each of the four U-shaped columns 32, 34, 36 and 38 are coated with grease to improve operation and longevity of parts. The dust cover 112 helps keep dust and dirt out of this grease and away from the moving parts but does not hamper operation of the vehicle lift 20 in any manner.

As shown in FIG. 9 an electrical contact shut off switch 114 may be slidably mounted within at least one of the four spaced-apart U-shaped columns 32, 34, 36 and 38. When the spaced apart ramps 22 and 24 are elevated to a desired vertical position, the shut off switch 114 is pre-positioned at a point within the column 32, 34, 36 or 38 where it contacts a portion of the cross member end block 30 and is then secured into place. When the end block 30 contacts the shut off switch during subsequent operation of the vehicle lift, the shut off switch 114 will be activated and the electric supply to hydraulic pump 10 will be interrupted.

Referring to FIG. 9, the cables 72, 74, 76 and 78 engage pulleys 60, 62, 64 and 66 respectively and are maintained substantially in the center of each column 32, 34, 36 and 38. Each cable 72, 74, 76 and 78 is fastened in the center of the top cap 48, 50, 52, 54 or each respective U-shaped column 32, 34, 36 and 38 so that downward directional force, produced by the weight of the vehicle on the ramps 22 and 24 is substantially perpendicular to the ramps 22 and 24. This arrangement directs the created downward force toward the center of each base 40, 42, 44, 46 of each of the respective U-shaped columns 32, 34, 36 and 38. The downward directional force at the center of each of the columns 32, 34, 36 and 38 greatly increases the stability of the device when a vehicle is elevated.

Figure 10:
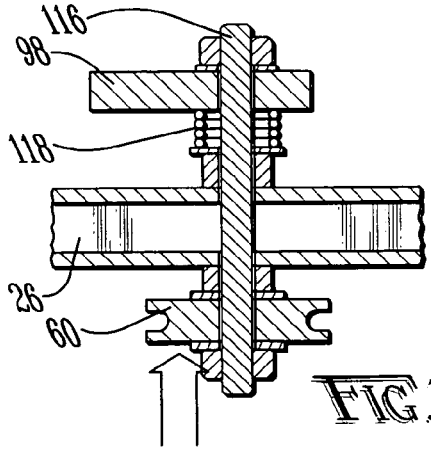
FIG. 10 is a cutaway view taken along line 15—15 in FIG. 9.

FIG. 10 is taken along line 15—15 in FIG. 9 and is a cutaway view of the pulley 60 and latching mechanism of one of the end blocks 30. The lock latch 98 is rotatably mounted on a spindle 116 which is positioned transversely and substantially perpendicular through the front cross member 26 near the end block 30. The entire end block 30, pulley 60 and lock latch 98 are within the U-shaped column 32 thereby limiting physical contact with the moving components during operation of the device. Further, this positioning keeps the components free of dust and dirt. The spindle 116 allows pulley 60 to turn independently of the lock latch 98. Tension which is required to maintain the lock latch 98 in a locked position within the spaced apart vertical locking tabs 96 is provided by a tension spring 118 mounted about the spindle 116 adjacent the lock latch 98.

One of the most significant benefits of the present invention is the stability of the device when a heavy vehicle is lifted and maintained in an elevated position. The positioning of the cables 72, 74, 76 and 78 in the center of each respective column 32, 34, 36 and 38 directs the forces, created during elevation of a vehicle, at substantially ninety degree angles. This also decreases the force, and driving power, required to elevate a vehicle, in comparison to related art devices, such as the one shown in FIG. 11. As shown, four column vehicle lifts generally attach the operating mechanism at the top of each column at, or near, the outer periphery, usually an overhang. This creates directional forces greater than ninety degrees and causes tremendous forces on each column, and on the cables and hydraulics, or other lifting means. If the cable is attached to an overhanging portion of the top of each column, a stress point occurs at the overhang, increasing the likelihood of a failure at that point. The instant invention provides a safer, more dependable vehicle lift because the position of the cables 72, 74, 76 and 78 in the center of each respective U-shaped column 32, 34, 36 and 38 provides safe, stable directional force during the elevation of a vehicle.

Figure 11:
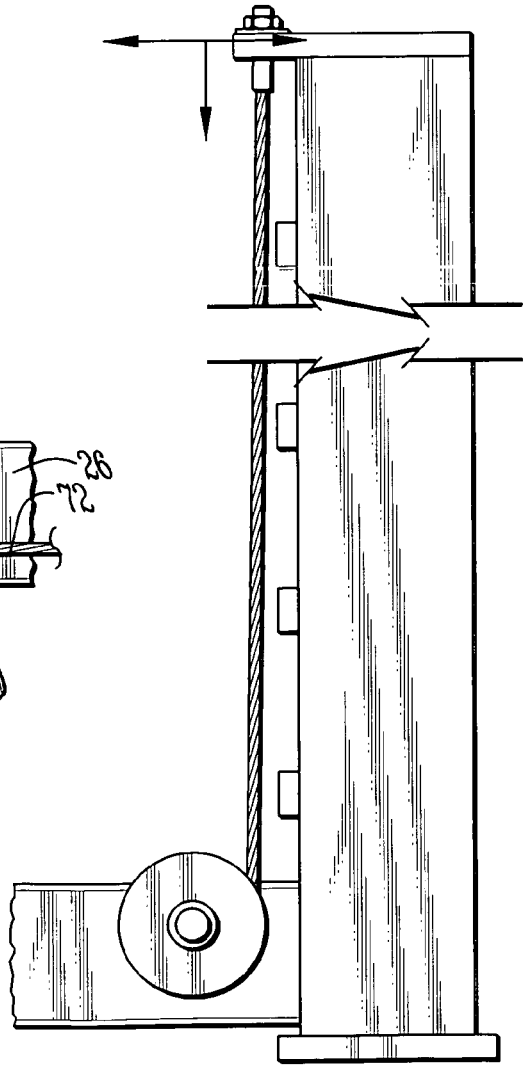
FIG. 11 PRIOR ART
FIG. 11 is a partial view of a prior art corner post.

Devices having external cable positioning, such as the one shown in FIG. 11, result in unstable lifting of vehicles and increases the likelihood of injury or accident. If the columns are not fastened securely to a surface, it is possible that the lift will collapse due to the inward angular force. Further, such devices encourage injury to operators by having exposed moving parts under great pressure.

Thus, there has been shown and described a unique four column vehicle lift which fulfills all of the objects and advantages sought therefore. It will be apparent to those skilled in the art, however, that many changes, variations, modifications and other uses and applications for the invention are possible, and also changes, variations, modifications, and other uses and applications which do not depart from the spirit and scope of the invention are deemed to be covered by the invention which is limited only by the claims which follow.

What is claimed is:

1. A vehicle lift comprising:

a) a pair of spaced-apart ramps;

b) at least two cross members attached to and supporting the pair of spaced-apart ramps, each of the at least two cross members further having at least two opposed end blocks and at least one pulley attached to each end block;

c) four spaced-apart U-shaped columns, each of the U-shaped columns having a base, a top cap, located opposite the base, and a cross member receiver slot wherein the end blocks on the cross members are slidingly received in the slot;

d) a hydraulic cylinder; and, e) a plurality of cables, each cable fixed at one end substantially in the center of the top cap of one of the U-shaped columns and the opposite end to the hydraulic cylinder, so that when the hydraulic cylinder is actuated, upward and downward movement of the cross members and the spaced-apart ramps occurs.

2. The vehicle lift of claim 1, further comprising a plurality of spaced-apart locking tabs fixed in at least one of the four spaced-apart U-shaped columns.

3. The vehicle lift of claim 2, further comprising a locking mechanism fixed to at least one of the end blocks of the at least two cross members, adjacent the at least one U-shaped column having a plurality of spaced-apart locking tabs fixed therein, the locking mechanism further comprising a locking latch linked to a mechanical lever whereby actuation of the mechanical lever causes the locking latch to engage on of the plurality of spaced apart locking tabs in the U-shaped column, thereby preventing vertical movement of the cross member within the cross member receiver slot.

4. The vehicle lift of claim 2, further comprising at least one tire block removably mounted on at least one of the spaced-apart ramps.

5. The vehicle lift of claim 2, further comprising at least one drip tray removably mounted between the pair of spaced apart ramps.

6. The vehicle lift of claim 2, further comprising a caster mounted adjacent the base of each of the four spaced-apart U-shaped columns.

7. The vehicle lift of claim 2 further comprising a flexible slotted dust cover mounted over the cross member receiver slot of each of the four spaced-apart U-shaped columns.

8. The vehicle lift of claim 2, further comprising an automatic shut off switch slidably mounted within at least one of the four spaced-apart U-shaped columns, substantially adjacent the cable therein such that when during vertical movement, the end block of the cross member contacts the automatic shut off switch, the vertical movement stops.

9. A vehicle lift, comprising:

a) four spaced-apart U-shaped columns, each having a base and a top cap;

b) a pair of ramps;

c) at least two cross members supporting the pair of ramps, each of the at least two cross members having opposing ends slidably received and held within a cross member receiver slot in one of the four spaced-apart U-shaped columns;

d) a hydraulic cylinder;

e) at least one cable having a securing end fastened substantially at the center position of the top cap of one of the four spaced-apart U-shaped columns and further having a pulling end attached to the hydraulic cylinder; and wherein the at least one cable is maintained within the U-shaped column and is routed through a pulley on the end of one of the at least two cross members received within the U-shaped column, such that when operated, the hydraulic cylinder pulls said at least one cable through the pulley thereby raising the at least two cross members and the pair of ramps.

10. The vehicle lift of claim 9, further comprising a plurality of spaced-apart locking tabs fixed in at least one of the four spaced-apart U-shaped columns.

11. The vehicle lift of claim 10, further comprising an automatic shut off switch slidably mounted within at least one of the four spaced-apart U-shaped columns, substantially adjacent the cable therein such that when during vertical movement, the end block of the cross member contacts the automatic shut off switch, the vertical movement stops.

12. The vehicle lift of claim 9, further comprising a locking mechanism fixed to at least one of the end blocks of the at least two cross members, adjacent the at least one U-shaped column having a plurality of spaced-apart locking tabs fixed therein, the locking mechanism further comprising a locking latch linked to a mechanical lever whereby actuation of the mechanical lever causes the locking latch to engage on of the plurality of spaced apart locking tabs in the U-shaped column, thereby preventing vertical movement of the cross member within the cross member receiver slot.

13. The vehicle lift of claim 9, further comprising at least one tire block removably mounted on at least one of the spaced-apart ramps.

14. The vehicle lift of claim 9, further comprising at least one drip tray removably mounted between the pair of spaced apart ramps.

15. The vehicle lift of claim 9, further comprising a caster mounted adjacent the base of each of the four spaced-apart U-shaped columns.

16. The vehicle lift of claim 9 further comprising a flexible slotted dust cover mounted over the cross member receiver slot of each of the four spaced-apart U-shaped columns.

* * * * *